US012188479B2

(12) United States Patent
Peng et al.

(10) Patent No.: US 12,188,479 B2
(45) Date of Patent: Jan. 7, 2025

(54) FAN ASSEMBLY OF CLOTHES TREATMENT DEVICE AND CLOTHES TREATMENT DEVICE

(71) Applicant: WUXI FILIN ELECTRONICS CO., LTD., Wuxi (CN)

(72) Inventors: Yingqing Peng, Wuxi (CN); Guangqing Mei, Wuxi (CN)

(73) Assignee: WUXI FILIN ELECTRONICS CO., LTD., Wuxi (CN)

( * ) Notice: Subject to any disclaimer, the term of this patent is extended or adjusted under 35 U.S.C. 154(b) by 488 days.

(21) Appl. No.: 17/614,565

(22) PCT Filed: Nov. 28, 2019

(86) PCT No.: PCT/CN2019/121723

§ 371 (c)(1),
(2) Date: Nov. 29, 2021

(87) PCT Pub. No.: WO2021/082160

PCT Pub. Date: May 6, 2021

(65) Prior Publication Data

US 2022/0220968 A1 Jul. 14, 2022

(30) Foreign Application Priority Data

Oct. 28, 2019 (CN) ..... 201911033525.4
Oct. 28, 2019 (CN) ..... 201921828964.X

(51) Int. Cl.
*F04D 25/08* (2006.01)
*D06F 58/20* (2006.01)
(Continued)

(52) U.S. Cl.
CPC ..... *F04D 25/08* (2013.01); *D06F 58/20* (2013.01); *F04D 25/06* (2013.01); *F04D 29/281* (2013.01); *F04D 29/4226* (2013.01)

(58) Field of Classification Search
CPC ..... F04D 25/08; F04D 25/06; F04D 29/281; F04D 29/4226; F04D 25/082;
(Continued)

(56) References Cited

U.S. PATENT DOCUMENTS

2006/0150439 A1 7/2006 Latack et al.
2014/0047869 A1* 2/2014 Kim ..... D06F 58/22 68/19.2
(Continued)

FOREIGN PATENT DOCUMENTS

CN 1900537 A 1/2007
CN 103036351 A 4/2013
(Continued)

OTHER PUBLICATIONS

ISR for PCT application PCT/CN2019/121723.
(Continued)

*Primary Examiner* — J. Todd Newton
(74) *Attorney, Agent, or Firm* — Anova Law Group, PLLC

(57) ABSTRACT

A fan assembly for a clothes treatment device and a clothes treatment device. The fan assembly includes an air passage housing defining an installation cavity; an impeller rotatably provided in the installation cavity; and a motor provided in the air passage housing and including a stator and a rotor. The stator is fitted over an outside of the rotor, and the rotor is configured to drive the impeller to rotate. The motor extend towards an upper cover of the clothes treatment device and/or an inner wall of the air passage housing. A distance between an upper end of the motor and the upper cover is h1, and the h1 is greater than or equal to 5 mm. A distance between a lower end of the motor and the inner wall of the air passage housing in a vertical direction is h2, and the h2 is greater than or equal to 0.5 mm.

10 Claims, 6 Drawing Sheets

(51) Int. Cl.
*F04D 25/06* (2006.01)
*F04D 29/28* (2006.01)
*F04D 29/42* (2006.01)

(58) Field of Classification Search
CPC ..... F04D 29/4213; F04D 29/5806; F04D 25/0606; F04D 29/053; F04D 29/4206; F04D 29/661; D06F 58/20; D06F 25/00; D06F 58/04
USPC ..... 34/218
See application file for complete search history.

(56) References Cited

U.S. PATENT DOCUMENTS

| | | | |
|---|---|---|---|
| 2014/0208603 A1 | 7/2014 | Kim et al. | |
| 2019/0106832 A1* | 4/2019 | Cagliani | D06F 25/00 |

FOREIGN PATENT DOCUMENTS

| | | | |
|---|---|---|---|
| CN | 105544164 | A | 5/2016 |
| CN | 206245092 | U | 6/2017 |
| CN | 106939506 | A | 7/2017 |
| CN | 107761340 | A | 3/2018 |
| CN | 208123094 | U | 11/2018 |
| CN | 208533192 | U | 2/2019 |
| EP | 3162951 | A1 | 5/2017 |
| EP | 3339500 | A1 | 6/2018 |
| EP | 3467184 | A1 | 4/2019 |
| JP | S48113647 | U | 12/1973 |
| JP | S5060606 | U | 6/1975 |
| JP | 2007143611 | A | 6/2007 |
| JP | 2009082576 | A | 4/2009 |
| JP | 2010063869 | A | 3/2010 |
| JP | 2012228501 | A | 11/2012 |
| JP | 2016198310 | A | 12/2016 |

OTHER PUBLICATIONS

Japan Patent Office (JPO) The Office Action For JP Application No. 2021-573580 Jun. 28, 2023 6 Pages (Translation Included).
Search Report mailed Oct. 7, 2022 for EP application 19950840.9.
OA malled Nov. 29, 2022 for JP application 2021-573580.

* cited by examiner

FAN ASSEMBLY OF CLOTHES TREATMENT DEVICE AND CLOTHES TREATMENT DEVICE

CROSS-REFERENCES TO RELATED APPLICATIONS

The present disclosure is a national phase application of International Application No. PCT/CN2019/121723, filed on Nov. 28, 2019, which claims priority to Chinese Patent Application Serial No. 201921828964.X and 201911033525.4, filed on Oct. 28, 2019, the entireties of which are herein incorporated by reference.

FIELD

The present relates to the field of clothes treatment apparatus technologies, and more particular, to a fan assembly for a clothes treatment device and a clothes treatment device.

BACKGROUND

Air passage assemblies for drying clothes of clothes treatment devices in related art have limited space, and therefore, their motors mostly employ single-phase asynchronous external rotor motors. This may be conducive to timely heat dissipation of the motor, and ensure system's normal operation. However, this type of motors has complicated fabrication processes, making costs of the air passage assemblies assembled with these motors high.

SUMMARY

Since an air passage housing has small installation space for a motor, the motor has poor heat dissipation effect. Hence, in related art, an internal rotor motor generally will not be employed to drive. The patent applicant found that, space of the air passage housing in an up-down direction is available. Thus, the present application proposes a fan assembly for a clothes treatment device, which has low costs and simple production process.

The present application also proposes a clothes treatment device having the above fan assembly for the clothes treatment device.

The fan assembly for the clothes treatment device according to embodiments of the present application includes: an air passage housing defining an installation cavity; an impeller rotatably provided in the installation cavity; and a motor provided in the air passage housing and including a stator and a rotor, the stator being fitted over an outside of the rotor, and the rotor being configured to drive the impeller. The motor extends towards an upper cover of the clothes treatment device and/or an inner wall of the air passage housing; a distance between an upper end of the motor and the upper cover of the clothes treatment device is h1, and the h1 is greater than or equal to 5 mm; and a distance between a lower end of the motor and the inner wall of the air passage housing in a vertical direction is h2, and the h2 is greater than or equal to 0.5 mm.

In the fan assembly for the clothes treatment device according to embodiments of the present application, an external rotor motor in related art is changed to the internal rotor motor, the motor is arranged to extend towards an upper cover of the clothes treatment device and/or an inner wall of the air passage housing, to increase a size of the motor in the up-down direction. The increased size of the motor increases its heat dissipation area, to greatly promote heat dissipation efficiency of the motor. Furthermore, the h1 is set to be greater than or equal to 5 mm and the h2 is greater than or equal to 0.5 mm, this prevents the motor from interfering with other components while ensuring the heat dissipation efficiency, which is conducive to ensuring normal operation of the fan assembly. Therefore, the fan assembly for the clothes treatment device according to embodiments of the present application can significantly reduce costs, facilitate power output and coupling with an external impeller, and simplify production process, on basis of ensuring the heat dissipation efficiency of the motor.

According to some embodiments of the present application, the motor at least partially extends beyond the installation cavity, a distance that the lower end of the motor extends downwards beyond a lower outer surface of the installation cavity is h3, and a distance that the upper end of the motor extends upwards beyond an upper outer surface of the installation cavity is h4, and the h3 is greater than or equal to the h4.

Since the fan assembly is mostly assembled to a tub assembly of the clothes treatment device (that is, the fan assembly is movable with the tub assembly), an excessive size of the motor extending upwards will greatly increase possibility of its interference with the upper cover of the clothes treatment device. Meanwhile, since relative movement (e. g., large amplitude vibration) between the motor and the air passage housing is relatively small, the present application sets the motor to extend downwards to a relatively large size, and reduces the possibility of interference between the motor and the upper cover of the clothes treatment device in case of ensuring the size of the motor.

In some embodiments, the h3 is greater than or equal to 5 mm.

According to some embodiments of the present application, the h1 is greater than or equal to 10 mm.

According to some embodiments of the present application, the h2 is greater than or equal to 2 mm.

In some embodiments, the motor further includes a motor shaft coupled to the rotor, and the impeller is installed to the motor shaft; and a lower end of the motor shaft extends downwards beyond the installation cavity, and a distance between the lower end of the motor shaft and the inner wall of the air passage housing in the vertical direction is the h2. Since airflow is driven to move along an axial direction of the motor shaft, increased axial size of the motor has small influence on the airflow, to make it possible to use the internal rotor motor, and further reduce costs of the fan assembly.

In some examples, the impeller is coupled to the motor shaft by a coupling frame, an outer surface of the coupling frame forms an arc transition region, and at least a part of the arc transition region is formed and an absolute value of slope increases gradually from bottom to top.

Since at least a part of the arc transition region is formed and an absolute value of slope increases gradually from bottom to top, the outer surface of the coupling frame is protruded outwards. Thus, it is conducive to extending and lengthening the stator downwards in the axial direction, and the heat dissipation effect may be better, to effectively solve the heat dissipation problem.

According to some embodiments of the present application, the air passage housing defines an accommodating recess with an upward opening, the accommodating recess is adapted to at least partially extend into the installation cavity, and the motor is located in the accommodating recess.

In some embodiments, the air passage housing includes: a first air passage body, the installation cavity being defined in the first air passage body; and a second air passage body in communication with the first air passage body through the installation cavity, a cover plate being provided above the installation cavity, at least a part of the cover plate being recessed downwards to form the accommodating recess.

The clothes treatment device according to embodiments of the present application includes a fan assembly for a clothes treatment device of the above-described embodiments, and the clothes treatment device has drying function.

Embodiments of the present application will be given in part in the following descriptions, become apparent in part from the following descriptions, or be learned from the practice of the present application.

BRIEF DESCRIPTION OF THE DRAWINGS

Embodiments of the present application will become apparent and more readily appreciated from the following descriptions made with reference to the drawings, in which.

These and other embodiments of the present application will become apparent and more readily appreciated from the following descriptions made with reference to the drawings, in which.

Figure 1:
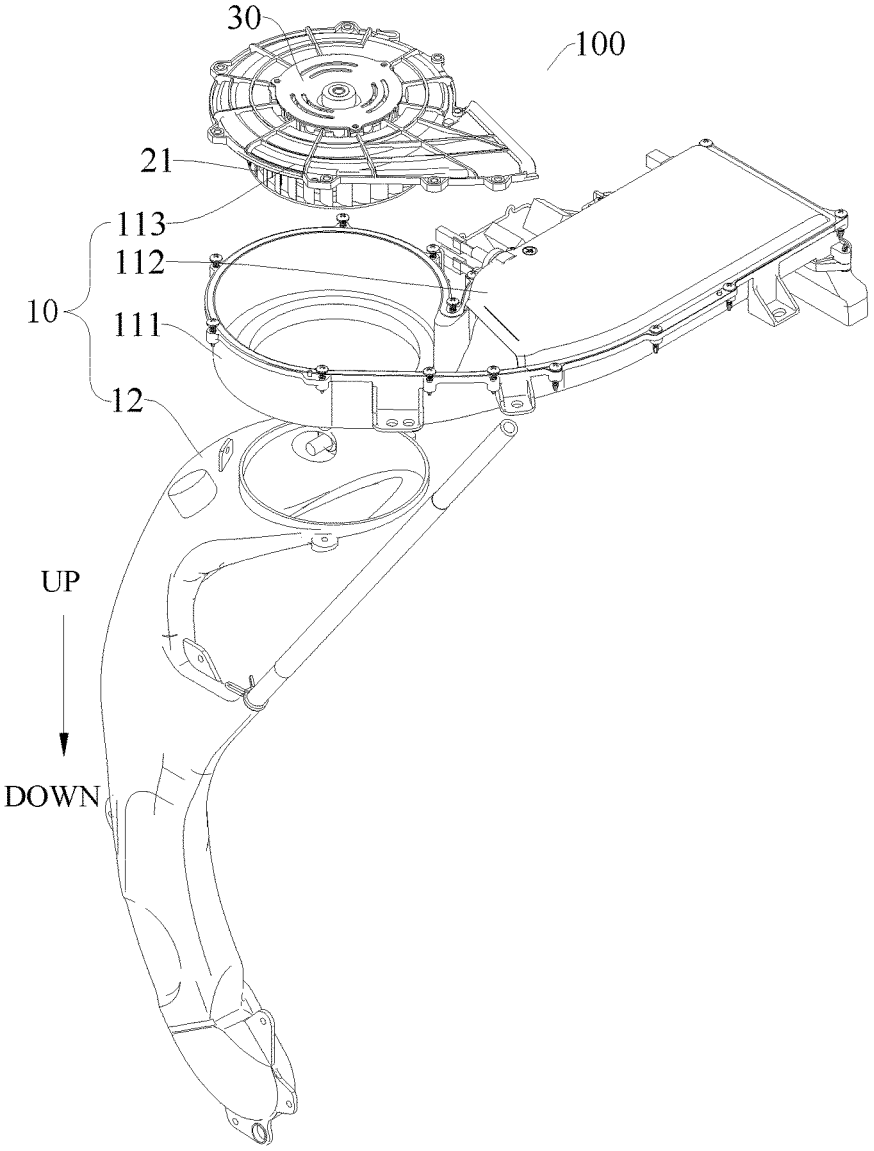
FIG. 1 is an exploded view of a fan assembly for a clothes treatment device according to an embodiment of the present application.

REFERENCE NUMERALS fan assembly 100,
air passage housing 10, installation cavity 101, accommodating recess 102,
first air passage body 11, base 111, cover body 112, cover plate 113, second air
passage body 12,
impeller 21, coupling frame 22, limit member 23,
motor 30, stator 31, rotor 32, motor shaft 33, motor casing 34, motor cover 35, bearing 36, first seal member 371, second seal member 372,
heating member 40,
clothes treatment device 200, upper cover 201.

DETAILED DESCRIPTION OF THE DISCLOSURE

Embodiments of the present application will be described in detail below, and examples of the embodiments are illustrated in the drawings, in which the same or similar elements and the elements having same or similar functions are denoted by like reference numerals throughout the descriptions. The embodiments described herein with reference to drawings are explanatory, used to generally explain the present application, and should not be construed as limitation to the present application.

A fan assembly 100 for a clothes treatment device according to embodiments of the present application will be described below with reference to FIGS. 1 to 6.

As illustrated in FIGS. 1 to 3 and 5, the fan assembly 100 for the clothes treatment device according to embodiments of the present application includes an air passage housing 10, an impeller 21 and a motor 30. The air passage housing 10 has an installation cavity 101, the impeller 21 is rotatably provided in the installation cavity 101, and the motor 30 is provided to the air passage housing 10 and configured to drive the impeller 21 to rotate, to produce airflow.

The motor 30 includes a stator 31 and a rotor 32, and the stator 31 is fitted over an outside of the rotor 32. That is to say, the motor 30 is an internal rotor motor. For example, the motor 30 may be a single-phase asynchronous internal rotor motor. The rotor 32 may be directly coupled to the impeller 21, and may also be indirectly coupled to the impeller 21, to drive the impeller 21 to rotate.

Since the air passage housing has small installation space for the motor, the motor has poor heat dissipation effect. Hence, in related art, an internal rotor motor generally will not be employed to drive the impeller. However, inventors of the present application found that, space of the air passage housing in an up-down direction is available. Hence, in the present application, the motor 30 is arranged to extend towards an upper cover 201 of the clothes treatment device 200 and/or an inner wall of the air passage housing 10, to increase a size of the motor 30 in the up-down direction. The increased size of the motor 30 increases its heat dissipation area, to greatly promote heat dissipation efficiency of the motor 30.

Further, a distance between an upper end of motor 30 (i. e., a surface of the motor 30 located at the highest position in a vertical direction) and the upper cover 201 of the clothes treatment device 200 in the vertical direction is h1, and the h1 is greater than or equal to 5 mm, which not only prevents the motor 30 in operation from producing noises due to collision with the upper cover 201 of the clothes treatment device 200, but also facilitates passage of the airflow and heat dissipation of the motor 30. A distance between an lower end of the motor 30 (i. e., a surface of the motor 30 located at the lowest position in the vertical direction) and the inner wall of the air passage housing 10 in the vertical direction is h2, and the h2 is greater than or equal to 0.5 mm, which may prevents the motor 30 from interfering with the inner wall of the air passage housing 10 when the motor 30 is in operation. That is, the motor 30 is prevented from interfering with other components while ensuring the heat dissipation efficiency, which is conducive to ensuring normal operation of the fan assembly 100.

Therefore, the fan assembly 100 for the clothes treatment device according to embodiments of the present application, by changing an external rotor motor in related art to the internal rotor motor, can significantly reduce costs, facilitate power output and coupling with an external impeller 21, and simplify production process, on basis of ensuring the heat dissipation efficiency of the motor 30.

Figure 2:
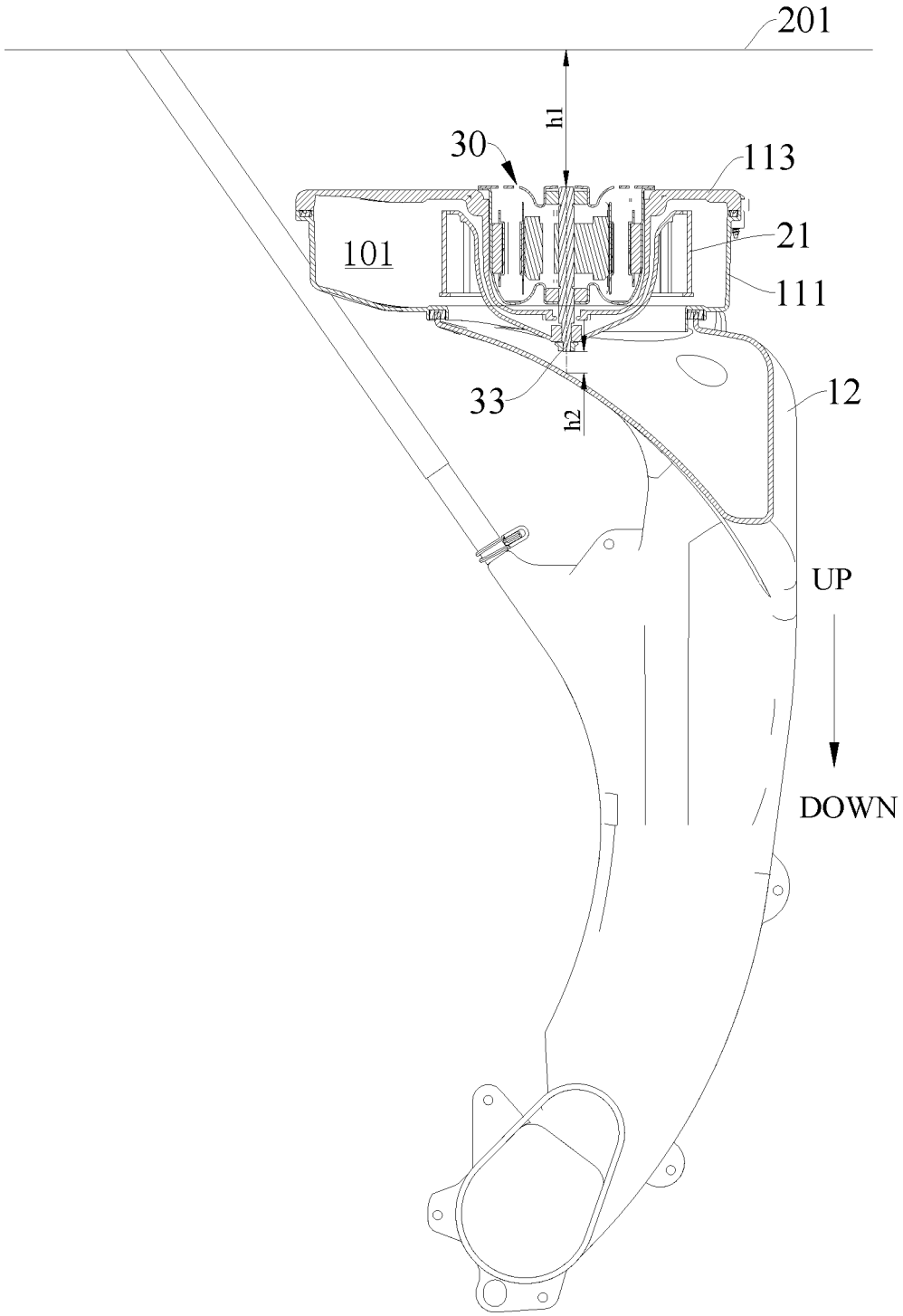
FIG. 2 is a cross-sectional view of a fan assembly for a clothes treatment device according to an embodiment of the present application in a direction.

As illustrated in FIG. 2, in order to better reduce possibility of collision between the motor 30 and the upper cover 201 of the clothes treatment device 200 when in operation, and ensure heat dissipation effect of the motor 30, in some embodiments, the h1 is set to be greater than or equal to 10 mm. For example, the h1 may be 10 mm, 11 mm, 12 mm, 13 mm, 14 mm, 15 mm, 20 mm, etc.

As illustrated in FIG. 2, in order to better reduce possibility of interference between the motor 30 and the inner wall of the air passage housing 10 when in operation, and ensure heat dissipation effect of the motor 30, in some embodiments, the h2 is set to be greater than or equal to 2 mm. For example, the h2 may be 2 mm, 2.1 mm, 2.2 mm, 2.3 mm, 2.4 mm, 2.5 mm, 3 mm, etc.

Thus, by limiting the distance between the upper end of the motor 30 and the upper cover 201 of the clothes treatment device 200 and the distance between the lower end of the motor 30 and the inner wall of the air passage housing 10 in the vertical direction as described above, the purpose of facilitating circulation of the airflow is achieved, an axial length of the stator 31 can be increased, and heat dissipation effect of the motor 30 can be improved and optimized significantly.

Figure 3:
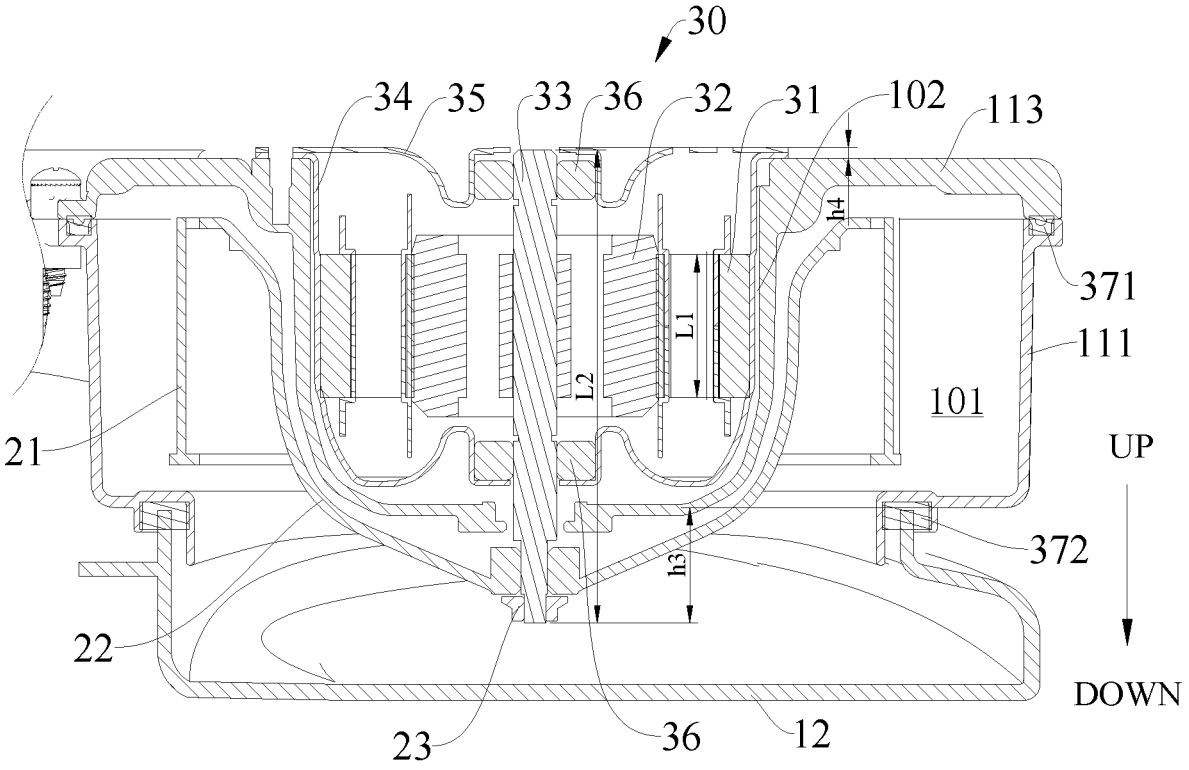
FIG. 3 is a cross-sectional view of a fan assembly for a clothes treatment device according to an embodiment of the present application in another direction.

As illustrated in FIG. 3, according to some embodiments of the present application, the motor 30 at least partially extends beyond the installation cavity 101. A distance that the lower end of the motor 30 (i. e., a lower surface of the motor 30) extends downwards beyond a lower outer surface of the installation cavity 101 is h3, a distance that the upper end of the motor 30 (i. e., an upper surface of the motor 30) extends upwards beyond an upper outer surface of the installation cavity 101 is h4, and h3 is greater than or equal to h4. That is, the upper end of the motor 30 is protruded upwards beyond an upper surface of a cover plate 113 described below, and the lower end of the motor 30 is protruded downwards beyond a lower surface of a base 111 described below.

Since the fan assembly is mostly assembled to a tub assembly of the clothes treatment device (that is, the fan assembly is movable with the tub assembly), an excessive size of the motor extending upwards will greatly increase possibility of its interference with the upper cover of the clothes treatment device. Meanwhile, since relative movement (e. g., large amplitude vibration) between the motor and the air passage housing is small, the present application sets the motor 30 to extend downwards to a relatively large size, and reduces the possibility of interference between the motor 30 and the upper cover 201 of the clothes treatment device 200 in case of ensuring the size of the motor 30.

In some embodiments, the h3 is greater than or equal to 5 mm. For example, the h3 may be 5 mm, 6 mm, 7 mm, 8 mm, 9 mm, 10 mm, etc.

As illustrated in FIG. 3, according to some embodiments of the present application, an axial (an up-down direction as illustrated in FIG. 3) length of the stator 31 of the motor 30 is L1, and the L1 is 15-40 mm. By increasing axial size of the stator 31 in the motor 30, heat dissipation of the motor 30 is faster and more effective.

In some embodiments, the axial length L1 of the stator 31 of the motor 30 is 15-30 mm. In one embodiment, the L1 may be 15 mm, 20 mm, 25 mm, or 30 mm, etc.

As illustrated in FIG. 3, according to some embodiments of the present application, an axial length of the motor 30 is L2, and the L2 is 50-100 mm. By limiting an axial size of the motor 30, heat dissipation problem of the internal rotor motor is improved and optimized.

In some embodiments, an axial length L2 of the motor 30 is 50-80 mm. In one embodiment, the L2 may be 50 mm, 60 mm, 70 mm or 80 mm, etc.

In some examples, the axial length L2 of the motor 30 is 86 mm, and the axial length L1 of the stator 31 of the motor 30 is 26 mm.

In further examples, the axial length L2 of the motor 30 is 50 mm, and the axial length L1 of the stator 31 of the motor 30 is 15 mm.

In other examples, the axial length L2 of the motor 30 is 100 mm, and the axial length L1 of the stator 31 of the motor 30 is 40 mm.

As illustrated in FIG. 3, according to some embodiments of the present application, the motor 30 also includes a motor shaft 33, the motor shaft 33 is coupled to the rotor 32, and the impeller 21 is installed to the motor shaft 33.

The lower end of the motor shaft 33 extends downwards beyond the installation cavity 101, and a distance between the lower end of the motor shaft 33 and the inner wall of the air passage housing 10 in the vertical direction is h2. That is, the distance between the lower end of the motor shaft 33 and the inner wall of the air passage housing 10 in the vertical direction is greater than or equal to 0.5 mm, which not only facilitates coupling between the motor shaft 33 and the impeller 21 to drive rotation of the impeller 21 by the motor shaft 33, but also reduces possibility of interference between the motor 30 and the upper cover 201 in case of ensuring the size of the motor 30.

In some embodiments, the impeller 21 is coupled to the motor shaft 33 by the coupling frame 22, an outer surface of the coupling frame 22 forms an arc transition region, and at least a part of the arc transition region is formed and an absolute value of slope increases gradually from bottom to top.

Thus, by forming the outer surface of the coupling frame 22 into the arc transition region, the impeller 21 can be installed on a position of the motor shaft 33 extending downwards beyond the installation cavity 101, that is, on basis of having no influence on installation of the impeller 21, the axial size of the stator 31 is increased, to increase the axial size of the motor 30 and ensure heat dissipation effect of the motor 30; furthermore, space of the fan assembly 100 in a horizontal direction can be increased to some extent, to further promote heat dissipation effect of the motor 30.

According to some embodiments of the present application, the air passage housing 10 defines an accommodating recess 102 with an upward opening, the accommodating recess 102 is adapted to extend at least partially into the installation cavity 101, and the motor 30 is located in the accommodating recess 102. In one embodiment, the motor 30 may be fixed in the accommodating recess 102 by a fastener such as a screw. By defining the accommodating recess 102 in the outer surface of the air passage housing 10, not only positioning of the motor 30 is facilitated, but also space outside the air passage housing 10 occupied by the motor 30 is reduced.

In some embodiments, the motor 30 also includes a motor shaft 33, the motor shaft 33 is coupled to the rotor 32, the lower end of the motor shaft 33 passes through a bottom wall of the accommodating recess 102, and the lower end of the motor shaft 33 is coupled to the impeller 21, to drive the impeller 21 to rotate. The lower end of the motor shaft 33 may be directly coupled to the impeller 21, and may also be indirectly coupled to the impeller 21.

In some examples, the impeller 21 is coupled to the motor shaft 33 the by the coupling frame 22. The coupling frame 22 has a shape matching a shape of the accommodating recess 102. For example, the outer surface of the coupling frame 22 forms an arc transition region, at least a part of the arc transition region is formed and an absolute value of slope increases gradually from bottom to top, and a gap is retained between the coupling frame 22 and the accommodating recess 102, to avoid interference between them.

In some embodiments, the air passage housing 10 includes a first air passage body 11 and a second air passage body 12. The installation cavity 101 is defined in the first air passage body 11, and the second air passage body 12 is in communication with the first air passage body 11 through the installation cavity 101. The cover plate 113 is provided above the installation cavity 101, and at least a part of the cover plate 113 is recessed downwards to form the accommodating recess 102.

In one embodiment, as illustrated in FIG. 3, the first air passage body 11 includes a base 111, a cover body 112 and a cover plate 113. The cover body 112 and the cover plate 113 overlay different positions of the base 111, respectively. The base 111 and the cover body 113 cooperatively define a first air passage, the base 111 and the cover plate 113 cooperatively define the installation cavity 101, the second air passage body 12 defines a second air passage, and the first air passage is in communication with the second air passage through the installation cavity 101.

In some examples, the upper end of the motor 30 is protruded beyond an upper outer surface of the air passage housing 10 (i. e., an upper surface of the cover plate 113), and the lower end of the motor 30 is protruded beyond a lower surface of the impeller 21.

In other examples, the upper end of the motor 30 is not protruded beyond the upper outer surface of the air passage housing 10 (i. e., the upper surface of the cover plate 113), and the lower end of the motor 30 is protruded beyond the lower surface of the impeller 21.

In further examples, the upper end of the motor 30 is protruded beyond the upper outer surface of the air passage housing 10 (i. e., the upper surface of the cover plate 113), and the lower end of the motor 30 is not protruded beyond the lower surface of the impeller 21.

In yet further examples, the upper end of the motor 30 is not protruded beyond the upper outer surface of the air passage housing 10 (i. e., the upper surface of the cover plate 113), and the lower end of the motor 30 is not protruded beyond the lower surface of the impeller 21.

In order to ensure sealing between the base 111 and the cover plate 113, a first seal member 371 is provided between the base 111 and the cover plate 113. In order to ensure sealing between the first air passage body 11 and the second air passage body 12, a second seal member 372 is provided between the first air passage body 11 and the second air passage body 12. That is, the second seal member 372 is provided between the base 111 and the second air passage body 12. The first air passage body 11 may be made from metal material, and the second air passage body 12 may be made from plastic.

A specific embodiment of a fan assembly 100 for a clothes treatment device according to the present application will be described in detail below with reference to FIGS. 1 to 6.

As illustrated in FIGS. 1 to 4, the fan assembly 100 for the clothes treatment device includes an air passage housing 10, an impeller 21 and a motor 30.

The air passage housing 10 includes a first air passage body 11 and a second air passage body 12.

The first air passage body 11 includes a base 111, a cover body 112 and a cover plate 113. The cover body 112 and the cover plate 113 overlay different positions of the base 111 respectively. The base 111 and the cover 113 cooperatively define a first air passage, and the base 111 and the cover plate 113 cooperatively defines an installation cavity 101. An upper portion of the base 111 defines a first installation groove, a first seal member 371 is provided in the first installation groove, and the cover plate 113 has a protrusion pressing on the first seal member 371, to couple the cover plate 113 and the upper portion of the base 111 with a seal. A middle portion of the cover plate 113 is arranged to recess downwards, to define an accommodating recess 102 with an upward opening in an outer surface of the middle portion of the cover plate 113, and a bottom wall of the accommodating recess 102 defines a through hole.

The second air passage body 12 is provided below the base 111, and the second air passage body 12 defines a second air passage. A lower portion of the base 111 defines a second installation groove, a second seal member 372 is provided in the second installation groove, and the second air passage body 12 has a flanging pressing on the second seal member 372, to couple the second air passage body 12 and the lower portion of the base 111 with a seal. The first air passage is in communication with the second air passage through the installation cavity 101.

The motor 30 is provided in the accommodating recess 102. The motor 30 includes a stator 31, a rotor 32, a motor shaft 33, a motor casing 34, a motor cover 35, and a bearing 36. The motor cover 35 is provided at a top of the motor casing 34, the accommodating cavity is defined between the motor cover 35 and the motor casing 34, bearings 36 are respectively provided at mutually opposite positions of the motor casing 34 and the motor cover 35, and two ends of the motor shaft 33 are respectively rotatably supported on the bearings 36 at corresponding positions. The stator 31 and the rotor 32 are both provided in the accommodating cavity, the stator 31 is fitted over an outside of the rotor 32, and the rotor 32 is fitted over an outside of the motor shaft 33 and coupled to the motor shaft 33, to drive the motor shaft 33 to rotate together. The motor shaft 33 extends in an up-down direction, and the lower end of the motor shaft 33 passes the through hole, to extend downwards beyond the installation cavity 101.

The impeller 21 is installed to the lower end of the motor shaft 33 by a coupling frame 22, and the lower end of the motor shaft 33 is also provided with a limit member 23, to have a limiting effect, and prevent the coupling frame 22 from separating from the lower end of the motor shaft 33.

Figure 5:
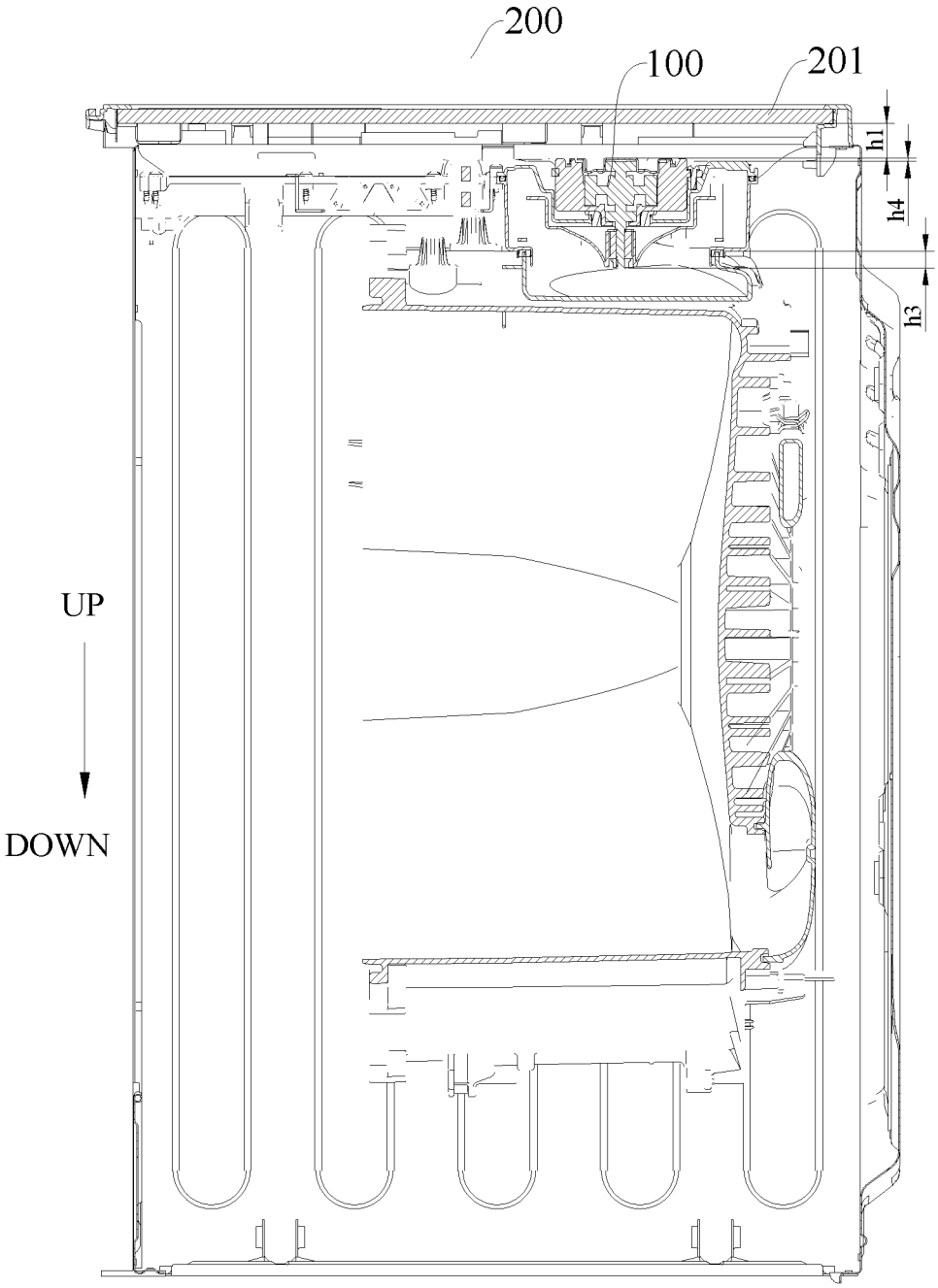
FIG. 5 is a cross-sectional view of a clothes treatment device according to an embodiment of the present application in a direction.
Figure 6:
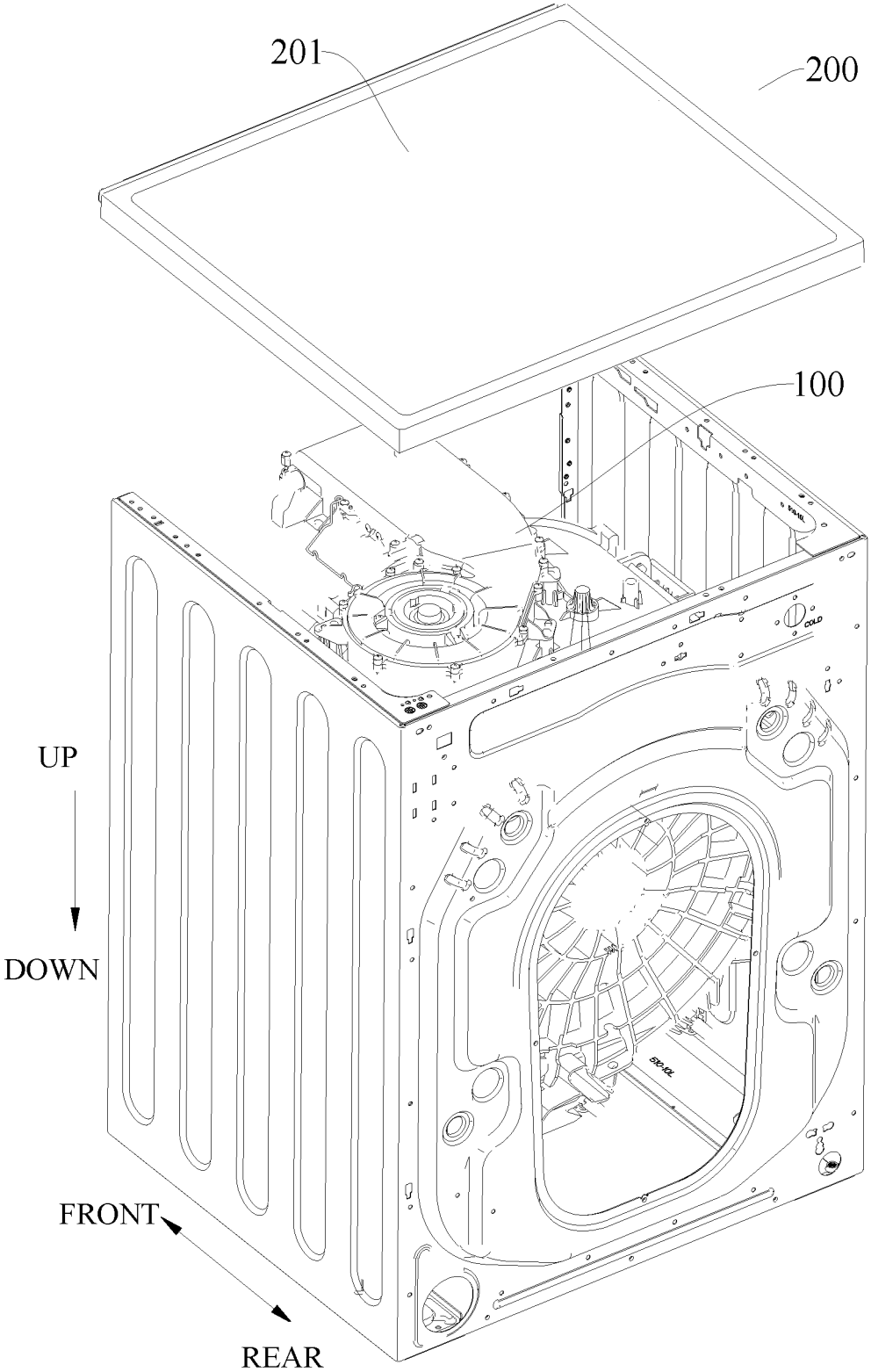
FIG. 6 is a partially exploded view of a clothes treatment device according to an embodiment of the present application.

As illustrated in FIGS. 3 and 5, a distance between an upper end of the motor 30 and an upper cover 201 of the clothes treatment device 200 in a vertical direction is h1, and the h1 is greater than or equal to 5 mm. A distance between a lower end of the motor 30 (i. e., a lower end of the motor shaft 33) and an inner wall of the air passage housing 10 in the vertical direction is h2, and the h2 is greater than or equal to 0.5 mm. The lower end of the motor 30 extends downwards beyond a lower surface of the base 111, a distance between the lower end of the motor 30 and the lower surface of the base 111 is h3, and the h3 is greater than or equal to 5 mm. The upper end of the motor 30 extends upwards beyond an upper surface of the cover plate 113, a distance between the upper end of the motor 30 and the upper surface of the cover plate 113 is h4, and the h4 is less than or equal to the h3. An axial length of the stator 31 of the motor 30 is L1, and the L1 is 15-40 mm. An axial length of the motor 30 is L2, and the L2 is 50-100 mm.

It should be noted that, the motor 30 of the present application is an internal rotor motor, at the same power, the axial length of the motor of the present application is less than an axial length of an external rotor motor in related art.

Figure 4:
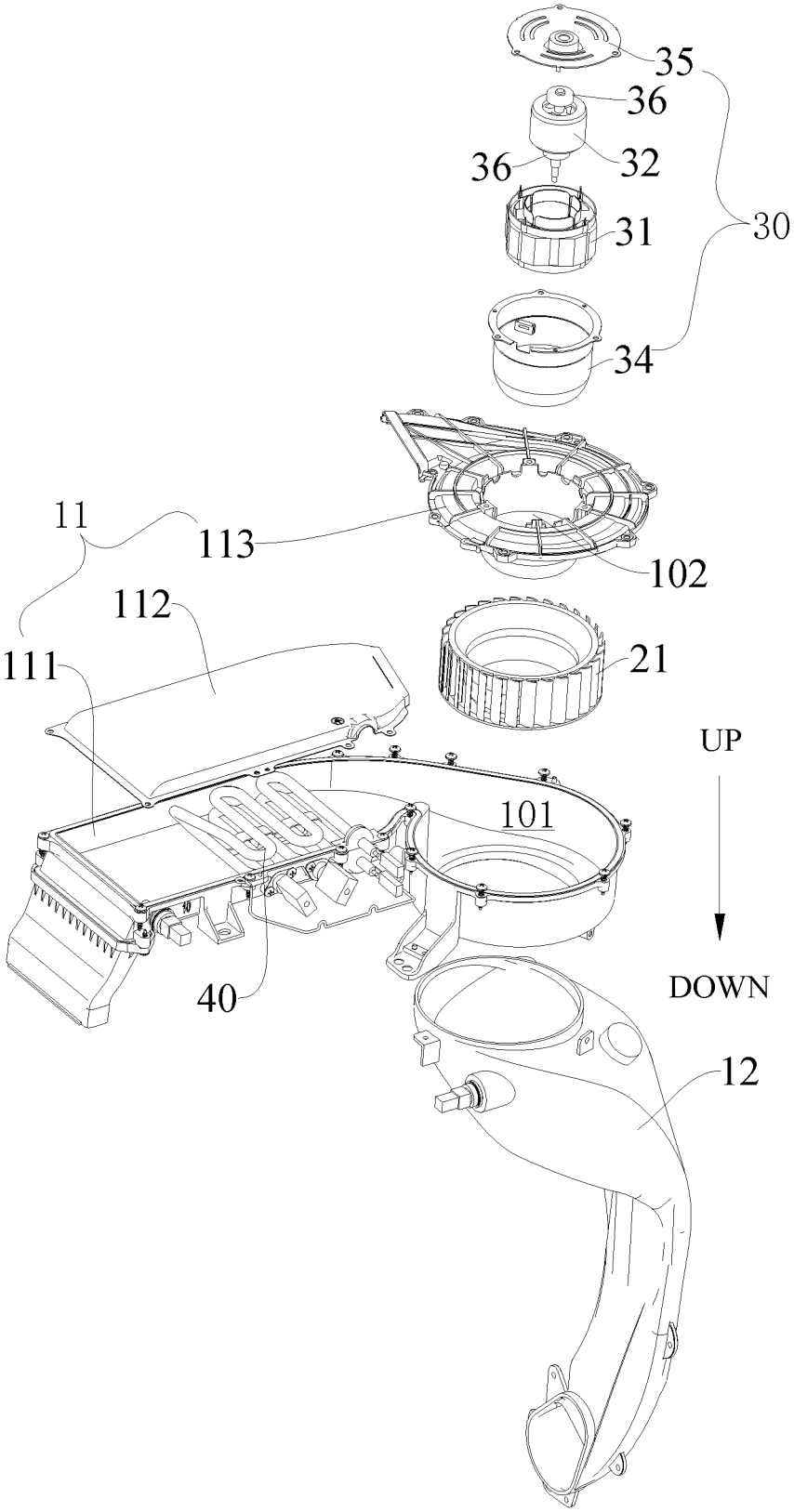
FIG. 4 is an exploded view of a fan assembly for a clothes treatment device according to an embodiment of the present application.

As illustrated in FIGS. 4 and 5, a clothes treatment device 200 according to embodiments of the present application includes a fan assembly 100 for the clothes treatment device of the above embodiments, and the clothes treatment device has a drying function. For example, this clothes treatment device may be a dryer, or a washer/dryer combo.

In one embodiment, the clothes treatment device 200 includes a cabinet, a tub assembly and the fan assembly 100. The tub assembly is provided in the cabinet, the fan assembly 100 is provided at a top of the tub assembly, and the fan assembly 100 is located between the tub assembly and an upper cover 201 of the cabinet.

Since the fan assembly 100 for the clothes treatment device according to embodiments of the present application has the above-described effects, the clothes treatment device 200 according to embodiments of the present application also has the above-described effects. That is, the clothes treatment device 200 of embodiments of the present application has low costs, simple production process, and good heat dissipation effect.

In the description of the present application, it is to be understood that terms such as "central," "length," "width," "thickness," "upper," "lower," "vertical," "horizontal," "top," "bottom," "inner," "outer," "axial," "radial," and "circumferential" should be construed to refer to the orientation as then described or as shown in the drawings under discussion. These relative terms are for convenience of description of the present application and simplification of the description, and do not indicate or suggest that the referred device or element must have a particular orientation, and be constructed or operated in a particular orientation. Therefore, they cannot be construed as limitations to the present application.

Other constitutions and operations of the clothes treatment device 200 according to embodiments of the present application will not be elaborated herein.

Reference throughout this specification to "an embodiment," "some embodiments," "schematic embodiment", "an example," "a specific example," or "some examples," means that a particular feature, structure, material, or characteristic described in connection with the embodiment or example is included in at least one embodiment or example of the present application. Thus, the schematic representations of the above phrases in this specification are not necessarily referring to the same embodiment or example. Furthermore, the particular features, structures, materials, or characteristics may be combined in any suitable manner in one or more embodiments or examples.

What is claimed is:

1. A fan assembly for a clothes treatment device, comprising:

an air passage housing defining an installation cavity;

an impeller rotatably provided in the installation cavity; and a motor provided in the air passage housing and comprising a stator and a rotor, the stator being fitted over an outside of the rotor, and the rotor being configured to drive the impeller, wherein:

the motor extends towards an upper cover of the clothes treatment device and/or an inner wall of the air passage housing; a distance between an upper end of the motor and the upper cover is h1, and the h1 is greater than or equal to 5 mm; and a distance between a lower end of the motor and the inner wall of the air passage housing in a vertical direction is h2, and the h2 is greater than or equal to 0.5 mm; and the motor at least partially extends beyond the installation cavity, a distance that the lower end of the motor extends downwards beyond a lower outer surface of the installation cavity is h3, and a distance that the upper end of the motor extends upwards beyond an upper outer surface of the installation cavity is h4, and the h3 is greater than the h4.

2. The fan assembly according to claim 1, wherein the h3 is greater than or equal to 5 mm.

3. The fan assembly according to claim 1, wherein the h1 is greater than or equal to 10 mm.

4. The fan assembly according to claim 1, wherein the h2 is greater than or equal to 2 mm.

5. The fan assembly according to claim 1, wherein the motor further comprises a motor shaft coupled to the rotor, and the impeller is installed to the motor shaft; and wherein a lower end of the motor shaft extends downwards beyond the installation cavity, and a distance between the lower end of the motor shaft and the inner wall of the air passage housing in the vertical direction is the h2.

6. The fan assembly according to claim 1, wherein the motor further comprises a motor shaft coupled to the rotor, the impeller is coupled to the motor shaft by a coupling frame, an outer surface of the coupling frame forms an arc transition region, and at least a part of the arc transition region is formed such that an absolute value of slope increases gradually from bottom to top.

7. The fan assembly according to claim 1, wherein the air passage housing defines an accommodating recess with an upward opening, the accommodating recess is adapted to at least partially extend into the installation cavity, and the motor is located in the accommodating recess.

8. The fan assembly according to claim 7, wherein the air passage housing comprises:

a first air passage body, the installation cavity being defined in the first air passage body; and a second air passage body in communication with the first air passage body through the installation cavity, a cover plate being provided above the installation cavity, at least a part of the cover plate being recessed downwards to form the accommodating recess.

9. A clothes treatment device, comprising:

a fan assembly comprising:

an air passage housing defining an installation cavity;

an impeller rotatably provided in the installation cavity; and a motor provided in the air passage housing and comprising a stator and a rotor, the stator being fitted over an outside of the rotor, and the rotor being configured to drive the impeller, wherein:

the motor extends towards an upper cover of the clothes treatment device and/or an inner wall of the air passage housing; a distance between an upper end of the motor and the upper cover is h1, and the h1 is greater than or equal to 5 mm; and a distance between a lower end of the motor and the inner wall of the air passage housing in a vertical direction is h2, and the h2 is greater than or equal to 0.5 mm; and the motor at least partially extends beyond the installation cavity, a distance that the lower end of the motor extends downwards beyond a lower outer surface of the installation cavity is h3, and a distance that the upper end of the motor extends upwards beyond an upper outer surface of the installation cavity is h4, and the h3 is greater than the h4.

10. A fan assembly for a clothes treatment device, comprising:

an air passage housing defining an installation cavity;

an impeller rotatably provided in the installation cavity; and a motor provided in the air passage housing and comprising a stator and a rotor, the stator being fitted over an outside of the rotor, and the rotor being configured to drive the impeller, wherein:

the motor extends towards an upper cover of the clothes treatment device and/or an inner wall of the air passage housing; a distance between an upper end of the motor and the upper cover is h1, and the h1 is greater than or equal to 5 mm; and a distance between a lower end of the motor and the inner wall of the air passage housing in a vertical direction is h2, and the h2 is greater than or equal to 0.5 mm; and the motor further comprises a motor shaft coupled to the rotor, the impeller is coupled to the motor shaft by a coupling frame, an outer surface of the coupling frame forms an arc transition region, and at least a part of the arc transition region is formed such that an absolute value of slope increases gradually from bottom to top.

* * * * *